US012022932B2

(12) United States Patent
Coquard

(10) Patent No.: US 12,022,932 B2
(45) Date of Patent: Jul. 2, 2024

(54) REFILLABLE CONTAINER DEVICE FOR A COSMETIC PRODUCT AND ASSOCIATED REFILL

(71) Applicant: CHANEL PARFUMS BEAUTE, Neuilly-sur-Seine (FR)

(72) Inventor: Christophe Coquard, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 228 days.

(21) Appl. No.: 17/215,271

(22) Filed: Mar. 29, 2021

(65) Prior Publication Data

US 2021/0298453 A1 Sep. 30, 2021

(30) Foreign Application Priority Data

Mar. 31, 2020 (FR) ..... 2003169

(51) Int. Cl.
*A45D 40/16* (2006.01)
*A45D 40/00* (2006.01)
(Continued)

(52) U.S. Cl.
CPC ..... *A45D 40/16* (2013.01); *A45D 40/0068* (2013.01); *B65D 77/0493* (2013.01); *A45D 2200/05* (2013.01); *B65D 2577/041* (2013.01)

(58) Field of Classification Search
CPC ..... A45D 2034/005; A45D 40/0068; A45D 40/16; A45D 2040/0006;
(Continued)

(56) References Cited

U.S. PATENT DOCUMENTS 7,942,281 B2 * 5/2011 Bloom ..... B65D 41/045 220/288
2003/0029876 A1 2/2003 Giraud
(Continued)

FOREIGN PATENT DOCUMENTS

DE 93 03 017 6/1993
DE 202004011963 U1 * 2/2005 ..... A45D 40/0068
(Continued)

OTHER PUBLICATIONS

French Search Report issued in French Patent Application No. 2003169, dated Nov. 17, 2020, and an English language translation of the Written Opinion thereof.

*Primary Examiner* — Anthony D Stashick
*Assistant Examiner* — Marcos Javier Rodriguez Molina
(74) *Attorney, Agent, or Firm* — GREENBLUM & BERNSTEIN, P.L.C.

(57) ABSTRACT

A refill for a container device for cosmetic product that includes a vessel configured to contain such a product, the vessel including a lateral wall. The lateral wall of the vessel has, over at least part of its outside surface, a member made of elastomer material connected to the vessel and which is at least partly in relief in relation to the outside surface of the lateral wall of the vessel. The refill thus formed is able to be held in a casing of suitable shape, by virtue of the members in relief of elastomer material formed on the outside wall of the vessel. The invention also relates to a casing for a cosmetic product container device including a casing and such a refill.

16 Claims, 4 Drawing Sheets

(51) Int. Cl.

| | |
|---|---|
| ***B65D 77/04*** | (2006.01) |
| *A45D 34/00* | (2006.01) |
| *B65D 25/00* | (2006.01) |
| *B65D 25/20* | (2006.01) |

(58) Field of Classification Search

CPC ..... A45D 2040/0025; A45D 2200/05; B65D 77/0486; B65D 8/00; B65D 25/00; B65D 25/02; B65D 2577/041; B65D 77/0493; B65D 53/04; B65D 2543/00537; B65D 55/12; B65D 41/023; B65D 43/02; B65D 43/0225; B65D 43/0231; B65D 45/16; B65D 47/18; B65D 47/24; B65D 5/5038; B65D 5/5088; B65D 51/32; B65D 55/02; B65D 77/0426; B65D 77/0433; B65D 81/133; B65D 83/0011; B65D 83/0016; B65D 83/0044; B65D 83/0409; B65D 88/54; B65D 2543/00203; B65D 2543/00231; B65D 2543/00527; B65D 2543/00629; B65D 2543/00703; B65D 43/0212; B65D 47/2006; B65D 47/268; B65D 47/305; B65D 53/02; B65D 55/00; B65D 83/0038; B65D 25/20; B65D 81/3876

USPC ..... 206/385, 1.5, 6.1, 204, 205, 210, 216, 206/235, 308.1, 362.3, 365, 366, 370, 206/438, 459.1, 459.5, 499, 503, 505, 206/508, 509, 525, 528, 540, 581, 588, 206/591, 592, 776, 812, 819, 823; 77/486; 215/4, 12.1, 12.2, 40, 43, 200, 215/206, 209, 211, 213, 216, 222, 223, 215/228, 230, 233, 235, 237, 238, 256, 215/273, 274, 278, 291, 296, 306, 307, 215/325, 330, 341, 343, 345, 352, 354, 215/355, 364, 365, 370, 383, 388, 390; 220/4.22, 4.27, 4.28, 23.83, 23.87, 23.89, 220/62.22, 200, 201, 203.11, 203.13, 212, 220/253, 254.1, 254.2, 254.3, 254.4, 220/254.7, 254.8, 255, 257.1, 258.5, 220/259.4, 260, 263, 264, 265, 266, 267, 220/270, 273, 276, 277, 278, 283, 284, 220/288, 291, 293, 298, 304, 315, 321, 220/323, 324, 326, 345.6, 348, 359.4, 220/361, 364, 375, 378, 380, 521, 522, 220/523, 531, 553, 560.1, 592.17, 592.2, 220/601, 619, 626, 630, 658, 662, 669, 220/671, 672, 675, 713, 715, 735, 780, 220/789, 792, 795, 796, 799, 800, 802, 220/806, 810, 822, 826, 830, 831, 832, 220/833, 835, 837, 840, 847, 849, 906, 220/908, 920, DIG. 26; 222/1, 95, 105, 222/108, 129, 135, 148, 162, 173, 182, 222/184, 185.1, 189.09, 189.11, 205, 206, 222/207, 209, 211, 212, 213, 215, 216, 222/249, 252, 257, 321.1, 321.3, 321.7, 222/321.9, 340, 341, 344, 362, 365, 380, 222/383.1, 386, 386.5, 389, 402.1, 222/402.12, 402.13, 402.16, 449, 464.1, 222/481, 481.5, 482, 483, 490, 491, 492, 222/494, 495, 496, 504, 505, 511, 517, 222/562, 565, 570; 428/1, 114, 131, 134, 428/136, 137, 402, 542.6, 101

See application file for complete search history.

(56) References Cited

U.S. PATENT DOCUMENTS

| | | | | |
|---|---|---|---|---|
| 2008/0217344 | A1* | 9/2008 | Bodenbender ..... | A45D 40/0068 220/694 |
| 2015/0230583 | A1 | 8/2015 | Maelstaf et al. | |

FOREIGN PATENT DOCUMENTS

| | | | | |
|---|---|---|---|---|
| DE | 202004011963 | U1 * | 2/2005 | ..... A45D 40/0068 |
| EP | 0 661 012 | | 11/1994 | |
| FR | 2715384 | A1 * | 7/1995 | ..... A45D 40/0068 |
| FR | 2715384 | A1 * | 7/1995 | ..... A45D 40/0068 |
| FR | 2 995 199 | | 3/2014 | |
| JP | 2012-250733 | | 12/2012 | |
| JP | 2013-119399 | | 6/2013 | |
| WO | 02/49924 | | 6/2002 | |
| WO | 2019/058087 | | 3/2019 | |

* cited by examiner

REFILLABLE CONTAINER DEVICE FOR A COSMETIC PRODUCT AND ASSOCIATED REFILL

BACKGROUND

1. Field of the Invention

The present invention concerns the field of refillable container devices for cosmetic product. By cosmetic product is meant in particular all products for making up the skin, including the lips, and all compositions provided for application to the body, including what are referred to as care products such as moisturizing creams. It relates in particular to the field of refills for refillable container devices for cosmetic product.

2. Description of the Background

A container device for cosmetic product designates in general terms any receptacle employed to contain a cosmetic product for its preservation, its transport, its commercialization, or its use. For example, pots, bottles, cases, etc., employed to contain a cosmetic product are so designated.

By refill is meant a removable member comprising a vessel adapted to contain a cosmetic product, and which can be put on place in and removed from a casing which forms the outside surface of the refillable cosmetic product container device constituted by a casing and a refill.

Once in place in the casing, the refill must be properly held in the casing. In particular, it is to be avoided for the refill to be able to escape from the casing, when its is transported or used, at which times the pot may have any orientation, in particular the container device being completely turned over, whether this arises from a deliberate act or not. Furthermore, the refill should not move in the casing on use of the container device. The refill must stay fixed on dispensing of the product, for example when the user takes product from the refill.

Nevertheless, it must be possible for the refill to be extracted easily from the casing, for it to be replaced.

Known refillable container devices generally comprise systems for holding the refill in the casing which are visible and have poor aesthetics, and/or which require adaptations which are industrially complex or costly.

Document JP2013119399 thus discloses a pot for cosmetic product comprising a refill of which the general shape of the vessel is that of a cylinder of revolution and comprises reliefs which slide, by virtue of matching shapes, in vertical grooves provided in the casing of the pot to prevent the vessel from turning.

Document EP0661012 also discloses a pot device having a refill, comprising an inside vessel or receptacle which engages by virtue of matching shapes in an outside receptacle forming a casing, it being possible in particular for the inside receptacle to comprise a peripheral bead which cooperates with a groove formed inside the neck of the outside receptacle.

Document WO2019058087 also discloses a pot device having a refill with a configuration that is close, comprising an inside vessel or receptacle which engages by virtue of matching shapes in an outside receptacle forming a casing, the casing comprising a peripheral bead which cooperates with a groove formed on the outside surface of the vessel. The upper part of the casing has a neck comprising slots in which are inserted radial beads of the vessel to enable the latter to be held against rotation.

Thus, the container devices having a refill that are known in the state of the art are based on matching of shapes between the casing and the refill, which makes it possible for example by snap engagement (or other relative mechanical engagement) to hold the refill in the casing. This requires a particular shape of the casing and of the refill, which for example prevents use of a casing of conventional shape, such as a standard glass receptacle, to form a refillable container device.

SUMMARY

The invention is directed to overcoming the aforementioned drawbacks in whole or in part.

The invention thus relates to a refill for a container device for cosmetic product comprising a vessel configured to contain such a product, the vessel comprising a lateral wall. The lateral wall of the vessel has, over at least part of its outside surface, a member made of elastomer material connected to the vessel and which is at least partly in relief relative to said outside surface of the lateral wall of the vessel.

The refill thus formed is able to be held in a casing of suitable shape, by virtue of the members in relief of elastomer material formed on the outside wall of the vessel. The holding obtained, which nevertheless enables extraction of the refill, uses the elastic properties and the coefficient of friction of the elastomer material. The employment of the refill is thus very simple.

The member of elastomer material may be molded onto the vessel.

The vessel may be formed from a plastics material. The vessel and the member of elastomer material it possesses may be formed together by bi-material injection-molding.

The vessel can thus be produced by industrial processes that are known and mastered, which provide good cohesion between the vessel and the member of elastomer material it bears.

The elastomer material employed may for example be a thermoplastic elastomer or a silicone elastomer. It may have a hardness comprised between 20 degrees Shore A and 80 degrees Shore A. and preferably comprised between 40 degrees Shore A and 60 degrees Shore A.

The elastomer material employed and its hardness enable deformation thereof under a reasonable force, compatible with the application to a cosmetic product refill.

The member of elastomer material may be of variable thickness, such that it forms discrete projections distributed over the outside surface of the lateral wall of the vessel.

The member of elastomer material may extend over a periphery of the lateral wall of the vessel and form at least two projections distributed over said periphery, preferably at least three projections distributed over said periphery.

The member of elastomer material may extend in at least two strips, and preferably at least three strips, over the lateral wall of the vessel, said strips extending from an upper part of the vessel to a bottom of the vessel and continuing over an outside surface of said bottom on which they meet each other.

Different configurations of the member of elastomer material make it possible to adapt the bearing zones to the application, the holding of the refill, the holding force, the aesthetics, the complexity of implementation, etc.

The refill may for example be of the general shape of a cylinder of revolution, or frusto-conical or right prismatic.

The vessel may, for example, have an internal volume comprised between 10 mL and 200 mL.

These are configurations that are particularly suited to the implementation of the invention.

The invention also relates to a container device for cosmetic product comprising a casing and a refill as defined above, in which the casing comprises an opening configured to receive a refill, the outside surface of the lateral wall of the vessel of the refill having clearance relative to the casing inside surface, except at the location of all or part of the member of elastomer material, such that bearing zones of the member of elastomer material on said casing inside surface are formed.

As the holding of the refill in the casing is provided in bearing zones of an inner surface of the casing, the means enabling that holding may be invisible (if the casing is opaque) or at least very discrete, such that they are not detrimental to the aesthetics of the pot that is constituted.

The member of elastomer material may be deformed in said bearing zones by compression on the casing inside surface, compared with a configuration that the member of elastomer material adopts when not acted upon externally.

The deformation of the member of elastomer material over the bearing zones increases the force it applies to the casing inside surface, and thereby increases the friction forces which oppose the extraction of the refill.

In one embodiment, the casing inside surface is devoid of asperities such as snap-fastening rings, studs, apertures or grooves.

Not being based on a snap-fastening or screwing principle, or other engagement of one member in a member of matching shape, the holding of the refill does not require there to be formed on the casing any particular shape configured to cooperate with holding means of the refill.

In a container device as defined above, of which the refill vessel is filled with a cosmetic product, the casing and the refill may be configured such that a force required for the extraction of the refill is greater than or equal to twice, and preferably greater than or equal to two and a half times, the weight of the refill. In particular, the shape, the dimensions and the constitution of the member of elastomer material are configured so as to obtain the force required for the desired extraction of the refill.

This holding force enables a relatively easy withdrawal of the refill for its replacement. It corresponds to a desirable specification for conventional pots for cosmetics products.

The casing may be of plastics material, of glass, of stainless steel, of aluminum, or of wood.

The casing is as a matter of fact imbued with an aesthetic aspect which may be of the utmost importance in the field of cosmetic products.

The container device may in particular be a pot, for example a cream pot.

Still other particularities and advantages of the invention will appear in the following description.

BRIEF DESCRIPTION OF DRAWINGS

In the accompanying drawings, given by way of non-limiting example.

DETAILED DESCRIPTION

Figure 1:
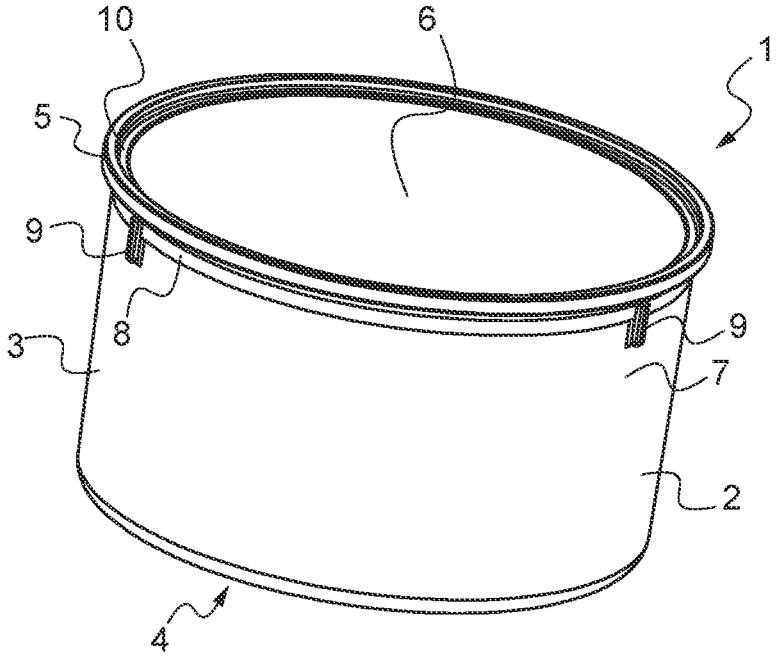
FIG. 1 shows, in a three-dimensional view, a first example of a refill in accordance with one embodiment of the invention.

FIG. 1 shows, in a three-dimensional view, a first example of a refill 1 in accordance with one embodiment of the invention. The refill 1 comprises a vessel 2 which is hollow, that is to say of which the shape forms a volume configured to receive a cosmetic product. In the example shown here, the vessel 2 has a cylindrical general shape, which may be right cylindrical or slightly flared (frusto-conical). Any hollow shape can however be envisioned to form the vessel, in particular any right prismatic shape, in particular having a shape that is square, rectangular, pentagonal, hexagonal, octagonal, etc.

The vessel 2 in particular has a lateral wall 3 and a bottom 4.

The vessel comprises, in the example shown, an upper rim 5. The rim 5 is formed around an open face 6 of the vessel 2.

A cosmetic product, for example a cream, may be contained in the volume formed inside the vessel. The open face of the vessel may be covered with a removable cap, for example a plate for protecting the product, for example bearing on the rim 5 and/or on a shoulder 10 formed in the upper part of the vessel. The vessel may also comprise a closure, for example heat-sealed, covering the open face 6 and that has to be removed when the refill is first used. The open face may be clear, directly exposing the product contained in the vessel 2 of the refill, or be equipped with a regulating device, such as a screen, a net, or other device configured for the product to dispense.

The vessel, in particular the lateral wall 3 of the vessel 2, has, on its outside surface 7 (that is to say the opposite surface of the wall to that forming the inside volume of the vessel 2) a member of elastomer material 8. The member of elastomer material 8 is intimately connected to the vessel.

Typically, the member of elastomer material may be molded onto the vessel 2.

Overmolding of the member of elastomer material 8 onto the refill 2 is possible in particular onto a refill formed from plastics material, metal, glass or another material compatible with overmolding.

When the refill 2 is made from a plastics material, the member of elastomer material and the refill can be formed by bi-material injection molding.

The elastomer materials usable to form the member of elastomer material all comprise thermoplastic elastomers (TPE) as well as silicone elastomers. The usable materials advantageously have a Shore A hardness comprised between 20 degrees Shore A and 80 degrees Shore A (preferably between 40 and 60 degrees Shore A).

The hardness of the material employed is an important parameter in the optimization of the refill, and is chosen in particular according to the dimensions of the vessel of the refill and according to the material used to form the casing for receiving the refill to form a container device for a cosmetic product (for example a pot).

The member of elastomer material 8 is in relief relative to the outside surface 7 of the lateral wall 3 of the vessel. In other words, over at least part of the member of elastomer material 8, the latter is proud relative to the outside surface 7 of the lateral wall 3.

Projections 9 may thus be formed by the member of elastomer material 8. These projections 9 form the parts of the member of elastomer material having a function of holding the refill in a casing, as detailed below with reference to FIGS. 5 to 7. The number, the dimensions, the shape, and the orientation of the projections 9 may vary according to the application considered. More generally, the configurations that can be envisioned for the member of elastomer material are numerous.

According to a first configuration, shown in FIG. 1, the member of elastomer material 8 passes around the vessel 2. Thus, the member of elastomer material 8 forms a peripheral strip on the outside surface of the lateral wall 3 of the vessel 2. This strip is formed in the upper part of the vessel 2, here, under the rim 5. This strip comprises three projections 9, distributed along the periphery of the vessel bearing said strip. With the exception of the projections 9 which are necessarily in relief relative to the outside surface 7 of the lateral wall 3 of the vessel, the rest of the member of elastomer material (that is to say the band formed around the vessel 2) may be in relief or flush with the outside surface 7. For this, a groove may be formed in the lateral wall 3 to receive said member of elastomer material 8. The distribution of the three projections 9 is preferably regular, that is to say that the projections are equidistant along the strip formed by the member of elastomer material. In the case of a vessel having the shape of a surface of revolution, this is results in a regular angular distribution of the projections 9 relative to the axis of revolution of the vessel 2.

In this embodiment, the projections 9 have a vertical disposition, that is to say that they form a member in relief having an elongate shape from top (open face 6) to bottom (bottom 4) of the vessel. For a vessel having the shape of a surface of revolution, this results in an orientation of the projections 9 parallel to the axis of revolution of the vessel. More generally, the projections are oriented perpendicularly to a plane materialized by the bottom 4 of the vessel, or if the bottom of the vessel does not materialize a plane (for example if the vessel is substantially spherical or a part of a sphere), the projections are oriented perpendicularly to the open face 6 of the vessel 2.

The embodiment of FIG. 1 has, among other advantages, the advantage that the member of elastomer material can be very inconspicuous on the vessel. Furthermore, the number of projections formed by the member of elastomer material may easily be adapted, with few modifications to the production tools.

Figure 2:
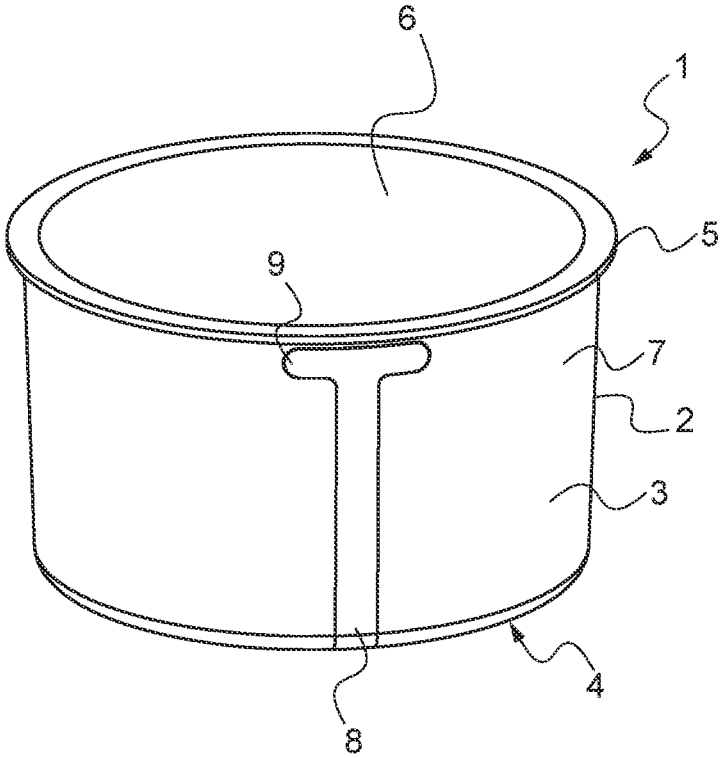
FIG. 2 shows, in a three-dimensional view, a second example of a refill in accordance with one embodiment of the invention.
Figure 3:
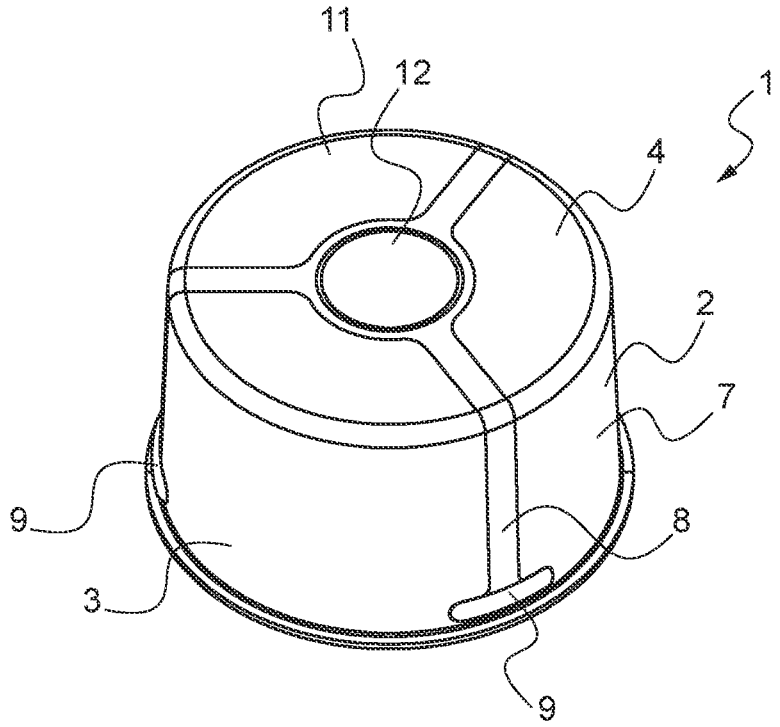
FIG. 3 shows, in another three-dimensional view, the refill of FIG. 2.

FIG. 2 and FIG. 3 present a second example embodiment of a refill in accordance with the invention, in two different views. The refill of FIG. 2 and of FIG. 3 essentially differ from that described above with reference to FIG. 1 by the shape of the member of elastomer material 8. Furthermore, the vessel of FIG. 2 and of FIG. 3 does not have a shoulder 10 in the top part. These two differences are independent from each other, the presence or absence of a shoulder on the vessel being independent from the configuration of the member of elastomer material 8.

In the example embodiment of FIG. 2 and of FIG. 3, the member of elastomer material 8 is configured in vertical strips extending over the outside surface 7 of the lateral wall 3 of the vessel 2. In this case, three vertical strips are formed by the member of elastomer material. The vertical strips are distributed over the outside surface 7 of the lateral wall 3 of the vessel 2, preferably with a regular distribution. In a regular distribution, the vertical strips are equidistant along the periphery of the vessel. In the case of a vessel having the shape of a surface of revolution, this is results in a regular angular distribution of the vertical strips formed by the member of elastomer material 8 relative to the axis of revolution of the vessel 2. In the example shown here, three vertical strips are formed on the outside surface 7 of the lateral wall 3 of the vessel 2.

The member of elastomer material 8 comprises a projection 9 at the top of each of the vertical strips it forms, that is to say in the vicinity of the open face 6. Just as for the embodiment of FIG. 1, with the exception of the projections 9 which are necessarily in relief relative to the outside surface 7 of the lateral wall 3 of the vessel, the rest of the member of elastomer material (that is to say the band formed around the vessel 2) may be in relief or flush with the outside surface 7.

Each projection 9 has a so-called horizontal orientation, perpendicular to a vertical orientation as defined above. Thus, each projection has an elongate shape, which extends parallel to a plane materialized by the bottom 4 of the vessel (or materialized by the open face 6).

Each vertical strip formed by the member of elastomer material on the outside surface 7 of the lateral wall 3 of the vessel 2 continues over an outside surface 11 of the bottom 4 of the vessel 2, on which surface they meet together. In the zone in which said strips meet on the outside surface 11 of the bottom 4, they can form area 12, for example circular, which can comprise text or a logo.

In the embodiment presented in FIGS. 2 and 3, the member of elastomer material can thus play an important aesthetic role, by having strips that are regular or that form a desired pattern (undulations, shapes evocative of a tree leaf, etc.). The fact that the vertical strips of the member of elastomer material meet makes it possible to have only one member of elastomer material on the vessel, which is advantageous compared with discrete members of elastomer material, in particular when the member of elastomer material is formed by overmolding or bi-material injection molding.

Figure 4:
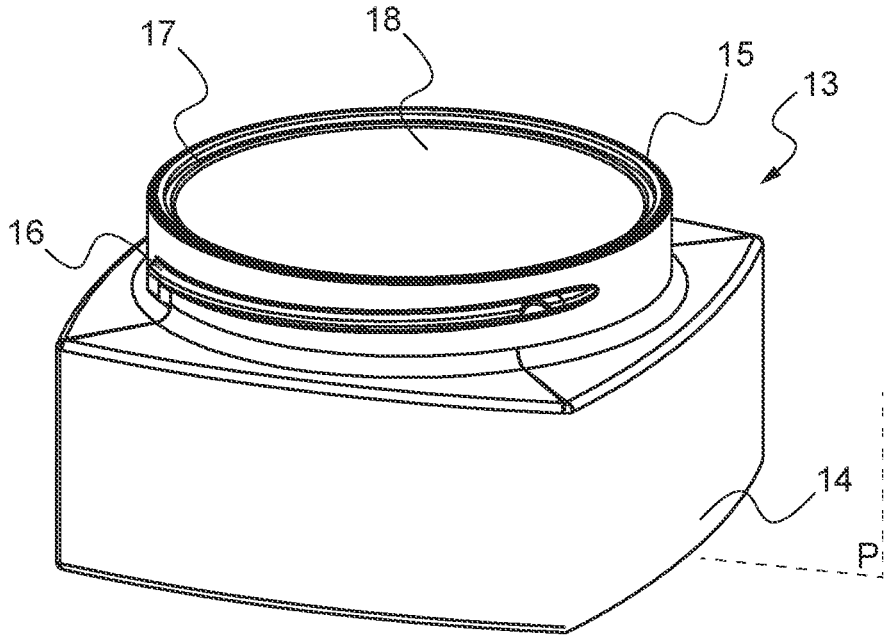
FIG. 4 shows, in the three dimensional view, an example of a casing that can be employed to form a cosmetic product container device with a refill in accordance with the invention.

FIG. 4 shows an example of a casing 13 that can be employed to form a container device for cosmetic product (here, a pot) with a refill 1 in accordance with the invention, for example the refill of FIG. 1 or the refill of FIGS. 2 and 3. The casing designates a member configured to receive a refill and in which the refill will be held. The casing of FIG. 4 is a bottle forming a volume configured to receive the refill 1. The casing 13 comprises a main body 14, of substantially prismatic shape with a square base, of which the lateral faces are slightly convex. As the casing 13 constitutes a visible part of the pot once the latter has been constituted, it has an important aesthetic function. The main body 14 of the casing 13 is surmounted with a neck 15 provided with a screw thread 16 making it possible to fit in place a screw lid (not shown). A shoulder 17 is formed at the mouth of the neck 15. The shoulder 17 is dimensioned so as to be able to receive, bearing thereon, the rim 5 of the vessel 2 of the refill 1.

The shoulder 17 is optional, it being possible for the refill to bear vertically on other surfaces of the casing, for example the rim 5 of the vessel 2 of the refill 1 can bear directly on the neck 15, or for example in the absence of a rim 5 on the vessel 2 of the refill, the bottom 4 of the vessel can bear on a bottom of the casing, if the latter comprises a bottom. A bottomless casing may be advantageous to facilitate the extraction of the refill.

It is notable that the casing 13 does not have any asperity at the location of the casing inside surface 18 provided to cooperate with the refill for holding it. By asperity is meant a volume, a member that is hollow or in relief, formed on a surface and of dimensions substantially greater than the possible roughness linked to the material constituting said surface. The casing inside surface 18 comprises in particular no snap-fastening ring, no pin, no aperture or any groove.

In the casing example shown, the casing inside surface 18 configured to cooperate with the refill for holding it constitutes the inside surface of the neck 15.

The casing shown in FIG. 4 can be made from glass. Any tint of glass may be employed, in particular transparent, translucent, opaque, colored or not colored.

The casing may be formed from numerous other materials, according to the appearance sought, the volume, the shape, and the manner of closure desired, etc. In particular, the casing may be of plastics material, wood, metal (such as stainless steel, tinplate, or aluminum).

In that the casing inside surface 18 does not comprise any asperities for the purpose of snap-fastening, screwing, etc. of the refill, a receptacle of conventional form may be employed, for example a conventional glassware receptacle having a screw, without requiring adaptation other than the addition of dimensions adapted to the refill. The manufacturing cost of the casing (and ultimately of the container device) can thus be reduced, compared with container devices of which the casing has to comprise specific members for fastening a refill.

Figure 5:
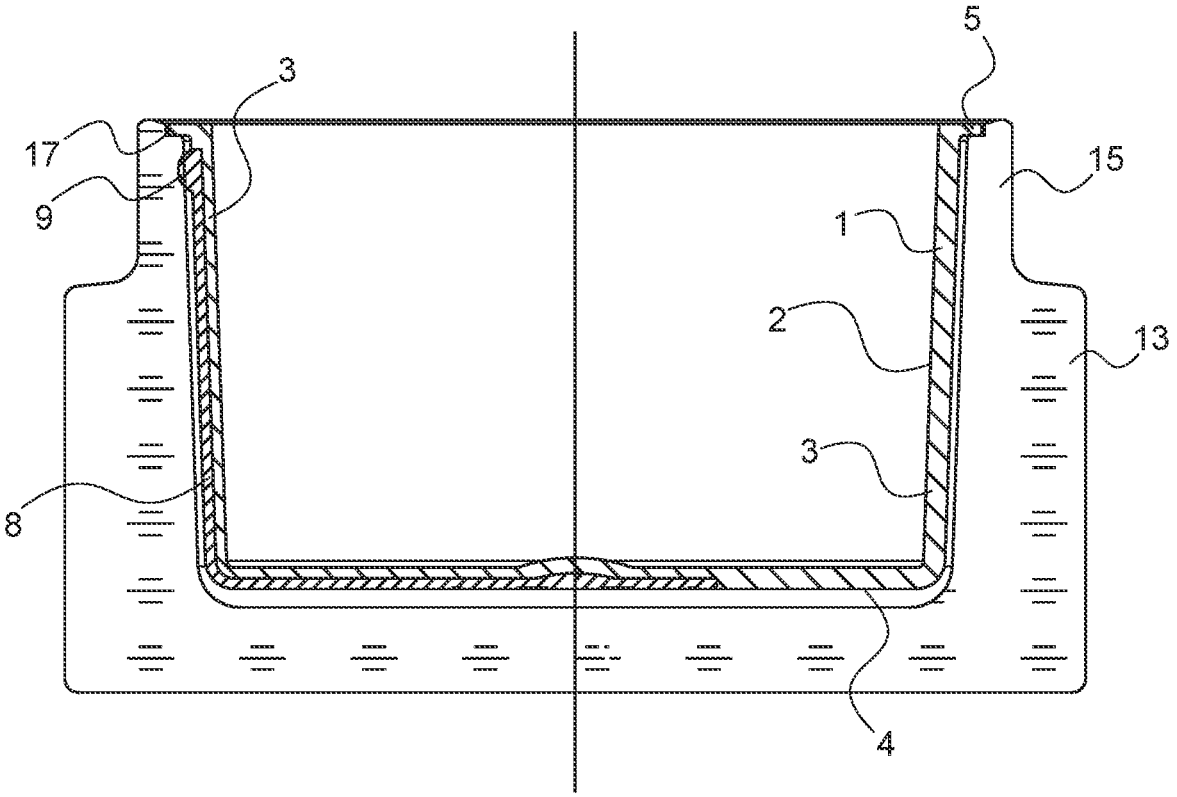
FIG. 5 shows, in a cross-section view, a cosmetic product container device, namely a pot, formed from the casing of FIG. 4 and from the refill of FIGS. 2 and 3.

FIG. 5 shows, in a cross-section view, a container device, namely a pot, formed from the casing of FIG. 4 and from the refill of FIGS. 2 and 3. The cross-section plane is a diametrical plane of the vessel 2 of the refill, and also forms a plane of symmetry of the casing 13, as shown in FIG. 4 (plane P).

The pot shown in FIG. 5 thus comprises a casing 13, in the form of a glass receptacle with a thick wall, which forms a volume in which the refill 1 is received. In the example shown the shape of the inside volume of the casing 13 thus matches, with clearance being the only difference, the shape of the outside of the vessel 2 (for example cylindrical or slightly frusto-conical). The depth of this volume is slightly greater than the overall height of the refill, such that the rim 5 of the refill bears on the shoulder 17 formed at the mouth of the neck 15.

Figure 6:
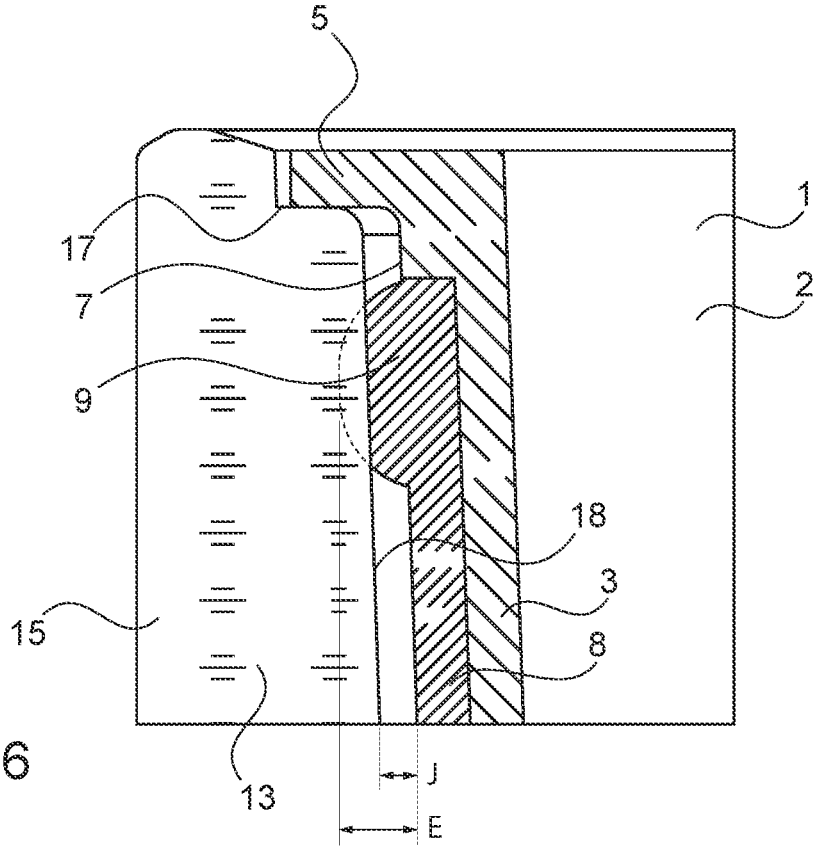
FIG. 6 shows, in a partial view in cross-section, the interaction between the casing and the refill in the container device of FIG. 5.

FIG. 6 shows a detailed view of the interaction between the casing and the refill in the pot of FIG. 5, based on the same cross-section plane as that of FIG. 5. FIG. 6 in particular reveals the bearing relationship formed between the rim 5 and the shoulder 17.

There is an amount of clearance J, for example of the order of 0.5 mm for a pot of cosmetic cream of conventional volume, for example of the order of 60 mL, between the casing inside surface 18 and the outside surface 7 of the lateral wall of the vessel 2. In the example shown, the member of elastomer material 8 is formed flush with the outside surface 7 with the exception of the projections 9 that it forms and which are in relief, projecting, relative to that outside surface 7. Thus, there is the same amount of clearance J between the casing inside surface 18 and the member of elastomer material 8, except at the location of the projections 9. Each projection 9 forms a protrusion relative to the level of the outside surface 7 of the lateral wall 3 of the vessel 2 of a thickness E greater than the clearance J, when the projection is not subjected to an external mechanical constraint, in particular when the projection 9 is not deformed by compression. This free configuration of the projection 9 is represented in dashed line in FIG. 6. In the example shown, the thickness E may be of the order of 1 mm, for example of the order of 0.9 mm.

In order to insert the refill 1 into the casing 13 until the rim 5 bears on the shoulder 17, it is necessary to deform the projection 9 for it to enter into the casing and for it to come to bear on the casing inside surface 18. When the refill 1 is in the casing 13, the projection 9 thus has a thickness, in relation to the outside surface 17 of the lateral wall 3 of the vessel 2, equal to the clearance J. The projection 9 thus takes up the clearance J and on account of its elasticity applies a bearing force on the casing inside surface 18.

There are advantageously several bearing projections distributed around the vessel 2, so as to distribute the bearing over the casing inside surface 18, and ensure effective and uniform holding of the vessel 2 in the casing 13. As a matter of fact, each bearing zone, formed at the location of each projection 9, forms a zone ensuring holding of the vessel 2 (and thus of the refill 1) in the casing 13. When a force tending to extract the refill 1 from the casing 13 is applied, a force opposing its extraction is created, by reaction, at the location of the projections, on account of the interaction between each projection 9 and the casing inside surface 18 onto which the projections 9 are compressed. This force is generated by friction of the projection 9 on the casing inside surface 18. So long as the vessel 2 is immobile in the casing 13, this is a so-called dry friction force, of which the intensity is, for each projection 9, at most equal to the coefficient of static friction between the projections 9 multiplied by the force applied between the casing inside surface 18 and the projection 9 due to its compression. When the force tending to extract the vessel from the casing 13 exceeds the sum of the maximum forces of static friction applied at the location of the projections 9, the refill begins to move relative to the casing for its extraction.

It thus appears that the number of the projections, their dimensions, the elastomer material employed, as well as the material constituting the casing and the surface state of the casing inside surface are parameters which make it possible to modulate the force required for the putting in place and for the extraction of the refill 1. As regards the member of elastomer material, the material it constitutes, the total bearing surface area (sum of the bearing surface areas) between said member of elastomer material and the casing inside surface 18, and the sum of the forces applied on account of the compression of said member of elastomer material are crucial parameters when determining the configuration for the member of elastomer material.

Whatever the embodiment considered, it is recommended, for a pot of cosmetic product, for the force required for the extraction of the refill to be at least two times greater than the weight of the full refill, for example of the order of two and a half times the weight of the full refill.

The presence of at least three regularly distributed projections, as in the example shown, furthermore enables the centering of the refill in the casing 13.

In order to facilitate the putting in place of the refill 1 in the casing 13, the projections 9 have, in the example of FIG. 6, a shape that is domed or beveled in the so-called vertical direction which, furthermore, corresponds to the direction of insertion (and of extraction) of the refill, which enables progressive compression of the projections on insertion of the refill 1 into the casing 13.

The position of the projections 9, in the upper part of the vessel 2, typically under the rim 5, makes it possible substantially to insert the refill into a casing 13 without effort, and to immobilize it in the casing by compression of the projections 9 at the end of the insertion.

Figure 7:
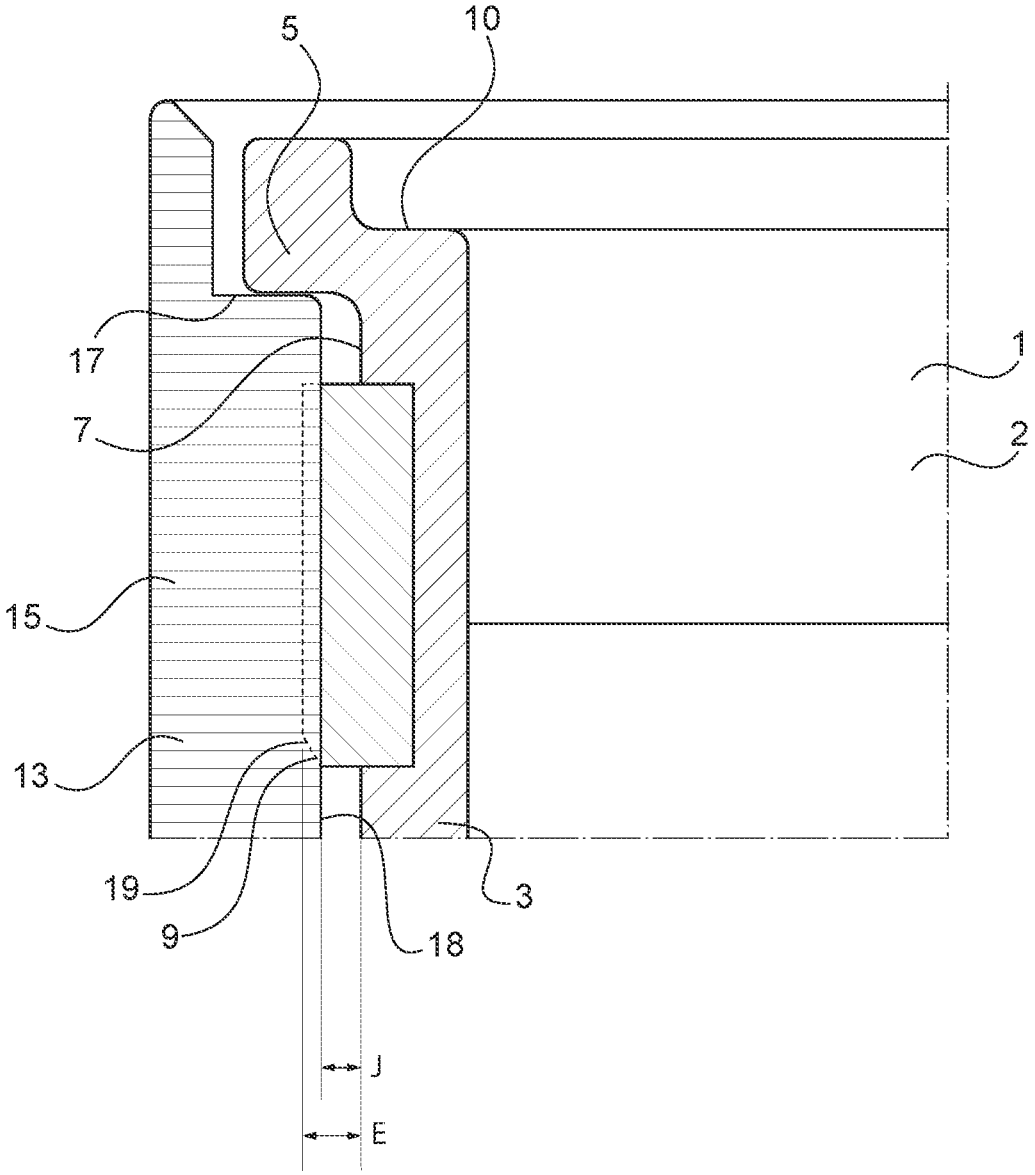
FIG. 7 shows, in a similar view to that of FIG. 6, the interaction between the casing and the refill of FIG. 1, in a container device formed with such a refill.

FIG. 7 shows, in a similar view to that of FIG. 6, the interaction between the casing and the refill of FIG. 1, in a pot formed with such a refill.

The embodiment of FIG. 7 differs from that shown in FIG. 6 essentially in the configuration of the member of elastomer material 8 and of the projections 9 that it forms. Nevertheless, all the explanations given as to the number of projections, the creation of a holding force by contact on the casing inside surface 18, etc. given with reference to FIG. 6, apply to the embodiment of FIG. 7.

As can be seen in FIG. 1, the projections 9 of the refill employed in the pot of FIG. 7 have a shape that is elongate vertically, that is to say parallel to the direction of insertion and of extraction of the refill. Just as for the embodiment detailed with reference to FIG. 6, the thickness E formed by the projection 9 in relation to the outside surface 7 of the lateral wall 3 of the vessel 2 is greater than the clearance J between said outside surface 7 and the casing inside surface 18. Thus, each projection 9 of the member of elastomer material 8 is compressed when the refill 1 is in place in the casing 13. In order to facilitate the insertion of the refill 1 into the casing 13, a chamfer 19 is formed on the projection 9.

On account of the vertically elongate shape of the projection 9, the latter is inserted progressively into the casing 13, which gives rise to a progressive increase in the force necessary for the putting in place of the refill 1 in the casing 13 (since the surface area of contact between the projections 9 of the vessel 2 and the casing inside surface 18 progressively and proportionally increases with the length of projection inserted) until contact is made between the rim 5 and the shoulder 17.

Although described with reference to two detailed embodiments, the present invention is of course not limited to those embodiments. In particular, the configuration of the elastomer member, of the vessel, and also of the casing may be very different from the configurations described above. For example, the presence of projections on the member of elastomer material is optional, provided that at least part of said member of elastomer material is in relief relative to the outside surface of the casing. Very varied forms of members of elastomer material may be envisioned. Several distinct members of elastomer material may be present on a same refill. The vessel may have varied shapes and constitutions according to the application considered. Similarly, the casing can have varied shapes and constitutions. For example, the casing may be cubic, cylindrical, cubic or parallelepiped, spherical, and may or may not have a bottom, or be provided with an aperture in its bottom to facilitate the extraction of a refill.

The invention thus developed enables the removable holding of a refill of cosmetic product in a casing in order to form a cosmetic product container device that is aesthetic and refillable by exchanging the refill. The holding is obtained by friction of the member of elastomer material on an inside surface of the casing. The holding means, in particular the elastomer member, may be totally invisible once the pot has been constituted, and be inconspicuous on the refill. The member of elastomer material can also constitute a member for visual or aesthetic differentiation, or for haptic differentiation for the product.

Furthermore, the casing may have a shape that is simple to produce, since the casing inside surface provided to interact with the member of elastomer material of the refill for holding it does not require the formation of any particular mechanical device. A preexisting receptacle, for example a conventional glassware receptacle, can thus be employed without adaptation as a casing of the cosmetic product container device.

The invention claimed is:

1. Container device for cosmetic product comprising:
a casing and a refill;
said refill comprising:
a vessel configured to contain the cosmetic product;
the vessel comprising a lateral wall having an outside surface;
over at least part of the outside surface of the lateral wall of the vessel, the outside surface has a member made of elastomer material in an intimate connection with the vessel as a result of
the member made of elastomer having been molded onto the vessel or the member made of elastomer having been formed together with the vessel by bi-material injection-molding, the member being at least partly in relief in relation to the outside surface of the lateral wall of the vessel, the member made of elastomer material being of variable thickness forming a plurality of discrete projections distributed over the outside surface of the lateral wall of the vessel; and
the casing comprising an opening and the refill being received in the opening, the outside surface of the lateral wall of the vessel of the refill having a clearance in relation to the casing inside surface, except at a location of the projections, such that bearing zones of the member of elastomer material on the casing inside surface are formed;
each projection forming a protrusion in relation to the level of the outside surface of the lateral wall of the vessel of a thickness greater than the clearance, when the projection is not subjected to an external mechanical constrain; and
wherein the member made of elastomer is deformed by a bearing force in the bearing zones.

2. Container device for cosmetic product according to claim 1, wherein:
the elastomer material is a thermoplastic elastomer or a silicone elastomer.

3. Container device for cosmetic product according to claim 1, wherein:
the elastomer material has a hardness comprised between 20 degrees Shore A and 80 degrees Shore A.

4. Container device for cosmetic product according to claim 1, wherein:
the elastomer material has a hardness comprised between 40 degrees Shore A and 60 degrees Shore A.

5. Container device for cosmetic product according to claim 1, wherein:
the member of elastomer material extends over a perimeter of the lateral wall of the vessel, and forms at least two projections set apart and distributed on the surface of the lateral wall.

6. Container device for cosmetic product according to claim 1, wherein:
the member of elastomer material extends over a perimeter of the lateral wall of the vessel, and forms at least three projections set apart and distributed on the surface of the lateral wall.

7. Container device for cosmetic product according to claim 5, wherein:

the member of elastomer material extends in at least two strips over the lateral wall of the vessel; and the strips extend from an upper part of the vessel to a bottom of the vessel and continuing over an outside surface of the bottom on which they meet each other.

8. Container device for cosmetic product according to claim 5, wherein:

the member of elastomer material extends in at least three strips over the lateral wall of the vessel; and the strips extend from an upper part of the vessel to a bottom of the vessel and continuing over an outside surface of the bottom on which they meet each other.

9. Container device for cosmetic product according to claim 1, wherein:

the vessel has a general shape selected from the group consisting of a cylinder of revolution, frusto-conical, and right prism.

10. Container device for cosmetic product according to claim 1, wherein:

the vessel has an internal volume comprised between 10 mL and 200 mL.

11. Container device for cosmetic product according to claim 1, wherein:

the member of elastomer material is deformed in the bearing zones by compression on the casing inside surface, compared to a configuration that the member of elastomer material adopts when not acted upon externally.

12. Container device for cosmetic product according to claim 1, wherein:

casing inside surface is devoid of asperities.

13. Container device for cosmetic product according to claim 1, wherein:

casing inside surface is devoid of any of the following asperities: snap-fastening rings, studs, apertures or grooves.

14. Container device for cosmetic product according to claim 1, wherein:

the vessel of the refill is filled with a cosmetic product;

a shape, dimensions, and a constitution of the member of elastomer material are configured such that a force required for extraction of the refill from the casing is greater than or equal to twice a weight of the refill.

15. Container device for cosmetic product according to claim 1, wherein:

the vessel of the refill is filled with a cosmetic product;

a shape, dimensions, and a constitution of the member of elastomer material are configured such that a force required for extraction of the refill from the casing is greater than or equal to two and a half times a weight of the refill.

16. Container device for cosmetic product according to claim 1, wherein:

the casing is of a material selected from the group consisting of plastics material, e-glass, stainless steel, aluminum, and wood.

* * * * *